US005273293A

United States Patent [19]

Lekavich

[11] Patent Number: 5,273,293

[45] Date of Patent: Dec. 28, 1993

[54] ARROW SHAFT

[76] Inventor: Carl W. Lekavich, 1645-3 W. Sepulveda, Torrance, Calif. 90501

[21] Appl. No.: 520,951

[22] Filed: May 4, 1990

Related U.S. Application Data

[63] Continuation of Ser. No. 256,166, Oct. 7, 1988, abandoned, which is a continuation of Ser. No. 876,395, Jun. 20, 1986, abandoned, which is a continuation-in-part of Ser. No. 659,873, Oct. 12, 1984, abandoned, which is a continuation-in-part of Ser. No. 513,223, Jul. 13, 1983, abandoned.

[51] Int. Cl.[5] ..... F42B 6/04

[52] U.S. Cl. ..... 273/416; 138/173

[58] Field of Search ..... 273/416, 419–423, 273/80 B, DIG. 23; 138/172, 173; 43/6; 464/183

[56] References Cited

U.S. PATENT DOCUMENTS

| | | | |
|---|---|---|---|
| Re. 18,666 | 11/1932 | Morgan | 273/80 B |
| 169,699 | 11/1875 | Hazelton | 138/173 X |
| 417,433 | 12/1889 | Lorenz | 43/6 |
| 469,731 | 3/1892 | Alterhouse | 138/173 X |
| 1,789,575 | 1/1931 | Allen | 273/420 |
| 1,794,051 | 2/1931 | Allen | 273/420 |
| 1,963,057 | 6/1934 | Wilcox | 273/80 B X |
| 1,999,601 | 4/1935 | Tengel | 273/416 |
| 2,074,987 | 3/1937 | Lagerblade | 273/80 B X |
| 2,467,838 | 4/1949 | Lust et al. | 273/418 |
| 2,747,876 | 5/1956 | Teller | 273/420 |
| 3,739,459 | 6/1973 | Otani | 138/173 X |
| 3,972,529 | 8/1976 | McNeil | 273/80 B |
| 4,050,696 | 9/1977 | Troncoso, Jr. | 273/420 |
| 4,084,819 | 4/1978 | Van Auken | 273/DIG. 23 X |
| 4,151,674 | 5/1979 | Klahn et al. | 102/503 X |
| 4,212,462 | 7/1980 | Glovak et al. | 273/424 |
| 4,214,932 | 7/1980 | Van Auken | 273/DIG. 23 X |
| 4,216,611 | 8/1980 | Psyras | 273/424 X |
| 4,399,992 | 8/1983 | Molitor | 273/DIG. 23 X |
| 4,436,305 | 3/1984 | Fernandez | 273/DIG. 23 X |
| 4,593,913 | 6/1986 | Kochevar | 273/420 |

FOREIGN PATENT DOCUMENTS

| | | | |
|---|---|---|---|
| 681109 | 9/1939 | Fed. Rep. of Germany | 464/183 |
| 2250090 | 5/1975 | France | 273/416 |
| 2387671 | 12/1978 | France | 273/416 |
| 15328 | of 1907 | United Kingdom | 273/416 |
| 30050 | of 1912 | United Kingdom | 273/80 B |
| 199369 | 12/1924 | United Kingdom | 138/172 |

OTHER PUBLICATIONS

Archer's Bible 1966–67 Mar. 1967 pp. 53–55.

Archer's Bible 1966–67 Mar. 1967 pp. 51–55.

Bow & Arrow Hunting Apr. 1985, Jan. 1985 p. 13.

Progress Report of the Howald-Meyers U.S. Pat. No. 2,571,717 Nov. 1955.

*Primary Examiner*—Paul E. Shapiro

*Attorney, Agent, or Firm*—Christie, Parker & Hale

[57] ABSTRACT

An arrow and its shaft wherein the shaft has a longitudinal axis extending between the arrowhead and the arrow nock. Flight feathers are disposed on the shaft near the nock to guide and rotate the arrow during flight. The shaft is hollow having longitudinally extended flutes to strengthen and stiffen the shaft. Strengthening and stiffening the shaft permits a smaller diameter shaft with a thinner wall thickness to be used to lighten the shaft and arrow without sacrificing the strength and stiffness of the arrow.

6 Claims, 3 Drawing Sheets

ARROW SHAFT

CROSS REFERENCES TO RELATED APPLICATIONS

This application is a continuation of Ser. No. 07/256,166 filed Oct. 7, 1988, which is a continuation of Ser. No. 06/876,395 filed Jun. 20, 1986, which is a continuation-in-part of Ser. No. 06/659,873 filed Oct. 12, 1984, which is a continuation-in-part of Ser. No. 06/513,223 filed Jul. 13, 1983, all abandoned.

FIELD OF THE INVENTION

This invention relates to arrows and more particularly arrow shafts.

BACKGROUND OF THE INVENTION

In the sport of archery, great advances have been made in the construction of bows. Today's modern bows are more compact and more efficient in imparting a momentum to an arrow.

Despite the improvements in the construction and design of bows, most arrows are constructed much the same as they have been for centuries. Historically, arrows have had a shaft usually constructed out of solid wood, an arrowhead mounted at one end and a nock at the other end to receive the bow string. Feathers, commonly referred to as the arrow's flight, are disposed on the arrow shaft near the nock to guide and rotate the arrow after it has left the bow.

To reduce the weight and increase its flight velocity for a given momentum and thereby its range, the traditional wooden shafts have been replaced by hollow metallic shafts. These shafts may be constructed from aluminum, steel, titanium or graphite composites with the overall goal being a lighter, yet strong, arrow shaft. Except for substituting modern materials for the traditional wooden arrow shaft, the design of the arrow has not been advanced.

There is, therefore, a need for a newly designed arrow shaft which is lighter, yet which is comparable to or exceeds the strength of arrow shafts heretofore found in the prior art.

SUMMARY OF THE INVENTION

There is, therefore, provided in the practice of this invention according to the presently preferred embodiments, a shaft for an arrow which is generally cylindrical, having a longitudinal axis extending from one end which is adapted to mount the arrowhead and an other end adapted to mount the nock. The arrow shaft includes longitudinally extended flutes which strengthen the hollow shaft and permit a thinner wall thickness to be used thereby resulting in a reduction of the overall weight of the arrow. In one embodiment, the flutes consist of outwardly projected arcuate protuberances whereas in other embodiments the flutes may consist of arcuate grooves or ribs, slots or flats.

BRIEF DESCRIPTION OF THE DRAWINGS

These and other features and advantages of the present invention will be appreciated as the same becomes better understood by reference to the following description of the present preferred embodiments when considered in connection with the accompanying drawings wherein.

DETAILED DESCRIPTION

Figure 1:
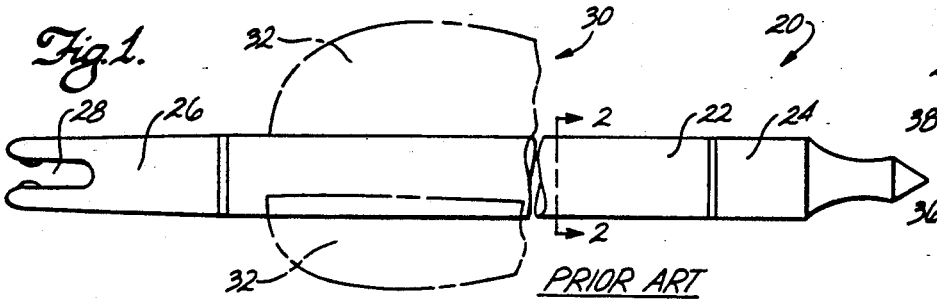
FIG. 1 is a side view of a typical arrow according to the prior art.
Figure 2:
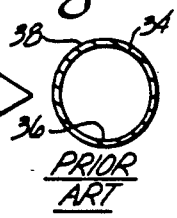
FIG. 2 is a section of the arrow shaft of FIG. 1 along line 2—2.

Turning to FIGS. 1 and 2, an arrow 20 according to the prior art is shown in detail. The arrow 20 includes a cylindrical hollow shaft 22 fashioned from, for example, aluminum, steel, titanium or graphite composite. The hollow shaft 22 has mounted at one end an arrowhead 24 and at the other end a nock 26. In a manner known in the prior art, the shaft 22 may have an axial, threaded bore in order to mount the arrowhead 24 shown as a field tip. The arrowhead 24 may be unscrewed from the shaft 22 for replacement and/or for storage of the arrow 20. The nock 26, as is also well known in the prior art, has a slot 28 adapted to receive the bow string which propels the arrow 20. A flight 30 consists of, for example, three feathers 32, two of which are shown as disposed on the shaft 22 near the nock 28 to rotate and stabilize the arrow 20 during flight. While the feathers 32 may actually be feathers, it is to be understood the feathers 32 may be of plastic or any other substitute material.

As seen in FIG. 2, the shaft 22 is hollow and cylindrical having a wall 34. The outer diameter of the wall 34 is defined by an external surface 36 and has an internal diameter defined by an internal surface 38. The distance between the external and internal surfaces 36 and 38 defines the wall thickness of the arrow shaft 22.

While dimensions may vary, a typical arrow 20 may have an aluminum shaft 22 with a wall 34 having an outer diameter of 21/64 (0.328) inches (8.33 mm) and a wall thickness of 0.017 inches (0.432 mm). Given these dimensions, the arrow 20 has a suitable stiffness so that the arrow 20 will not bend or wobble as it leaves the bow. Bending and/or wobbling of the arrow 20 affects the accuracy of the flight of the arrow 20.

To test the stiffness of the arrow 20, what is commonly referred to as a spine test is typically used. In the spine test, a standard length of shaft 22 of 28 inches (71.1 cm) is supported at its ends while a standard weight of two pounds (0.91 kg) is suspended from the middle. The deflection of the middle of the shaft is measured and is used as a standard to determine the stiffness of the arrow 20.

Figure 3:
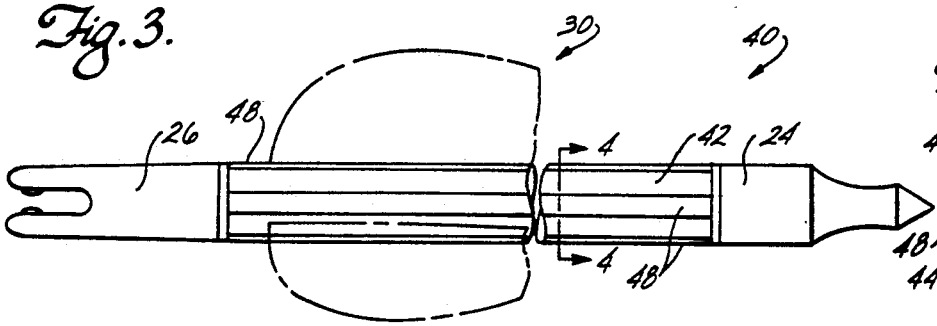
FIG. 3 is a side view of one embodiment of the arrow shaft according to the present invention.
Figure 4:
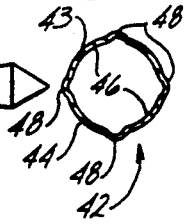
FIG. 4 is a section view of the arrow shaft of FIG. 3 taken along the line 4—4.

Turning to FIGS. 3 and 4, an embodiment of an arrow 40 according to the present invention is shown. The arrow 40 has a hollow, generally cylindrical shaft 42 with a longitudinal axis extending between the arrowhead 24 at one end and the nock 28 at the other end. As with the prior arrow 20, the flight 30, to rotate and stabilize the arrow 40 during flight, is disposed on the shaft 42 near the nock 28. Additionally, the shaft 42 may be provided with a threaded axial female bore to allow mounting of the arrowhead 24 in a manner according to that described above.

To strengthen the shaft 42 while permitting a reduction in weight, the shaft 42 includes longitudinally extended flutes. While the flutes preferrably extend the entire length of the shaft 42, it is to be understood that they may extend only partially along the shaft 42 or may be interrupted by a smooth cylindrical section or sections. To create and define the flutes, the shaft 42 has a wall 43 defined by a generally cylindrical external surface 44 and a following internal surface 46. At various locations, the wall 43 has longitudinally, outwardly extended arcuate protuberances 48 defining the aforementioned flutes. As can be appreciated from FIG. 4, to minimize the weight of the shaft 42, the thickness of the wall 43 is maintained substantially constant. While FIGS. 3 and 4 show the preferred embodiment of four protuberances 48 spanning approximately 40° of the wall 43 and disposed 90° apart from each other around the shaft 42, it is to be understood that fewer or more protuberances can be used or differently positioned depending on the desired stiffness and weight of the arrow 40. In the preferred embodiment, the apogee of the each protuberance 48 extend outward approximately ten percent of the radius of the cylindrical portion of the wall 43.

It has been found that by providing the flutes embodied as shown in FIGS. 3 and 4 as protuberances 48, the strength of the arrow shaft 42 can be enhanced permitting a substantial reduction in shaft diameter and wall thickness with a concomitant reduction of shaft weight. For example, it has been found that to obtain the same deviation on the spine test as the prior art arrow 20 described above, the arrow shaft 42 according to FIGS. 3 and 4, need only have an outside diameter (as measured between the protuberances 48) of 19/64 (0.297) inches (7.54 mm) with a 0.005 inches (0.127 mm) wall thickness. As can be appreciated, the reduction in the outer diameter and wall thickness of the arrow shaft 42 results in a substantial reduction of weight and therefore a faster arrow 40. Again, it is to be noted that the reduction in weight of the arrow shaft 42 does not result in a sacrifice of the arrow's stiffness or its strength due to the provisions of the protuberances 48.

Figure 5:
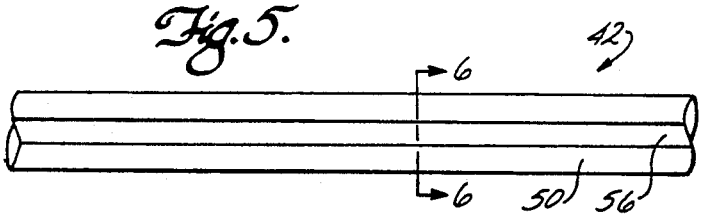
FIG. 5 is a partial side view of another embodiment of the arrow shaft according to the present invention.
Figure 6:
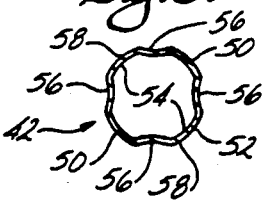
FIG. 6 is a section view of the arrow shaft of FIG. 5 taken along lines 6—6.

Turning to FIGS. 5 and 6, another embodiment of the arrow 40 according to the present invention is shown in detail. The hollow arrow shaft 42 has a generally cylindrical wall 50 having external and internal surfaces 52 and 54. Extending longitudinally down the shaft 42 are arcuate grooves 56 which, like the protuberances 48, are preferrably disposed at 90° intervals around the wall 50 and upon approximately 40° of the wall 50. Again, fewer or more grooves 56 spaced around the shaft 42 may be used as desired. Preferably, the grooves 56, at their perigee are indented approximately ten percent of the radius of the wall 50. It has been found that by providing the grooves 56, which in turn define interposed lands 58 extending longitudinally along the shaft 42, the strength and stiffness of the shaft 42 can be maintained while reducing the outside diameter and thickness of the wall 50. The reduction of the outside diameter and wall thickness reduces the weight of the arrow shaft 42 and the overall weight of the arrow 40 resulting in a faster arrow 40.

Figure 7:
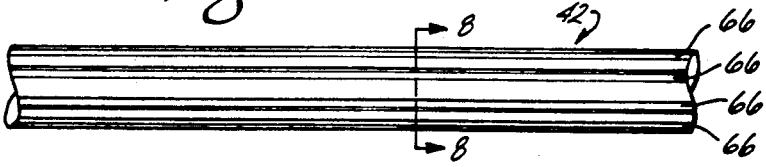
FIG. 7 is a partial side view of yet another embodiment of the arrow shaft of the present invention.
Figure 8:
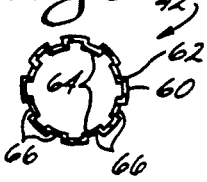
FIG. 8 is a section of the arrow shaft of FIG. 7 taken along line 8—8.

Turning to FIGS. 7 and 8, a further embodiment of the arrow 40 is shown in detail. To define the longitudinally extended flutes, the shaft 42 has a generally cylindrical wall 60 with an external surface 62 and a following internal surface 64. To define the longitudinally extended flutes, the wall 60 includes inwardly projected rectangular notches 66 extending longitudinally therealong. It is to be understood that any number of rectangular notches 66 may be used and that the eight notches 66 shown in FIG. 8 disposed at 45° intervals is merely for purposes of illustration. As can also be appreciated from FIG. 8, the thickness of the wall 60 is maintained substantially constant to minimize the weight of the shaft 42. Preferably, the notches 66 are indented approximately five percent of the radius of the wall 60. Like the previous embodiments of the arrow 40, the longitudinally extended notches 66 have been found to strengthen the shaft 42 so that the wall 60 may have a smaller outside diameter and wall thickness.

Figure 9:
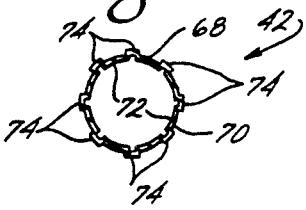
FIG. 9 is a section view of another embodiment of the arrow shaft according to the present invention.

Turning to FIG. 9 is yet another embodiment of the arrow 40 according to the present invention. To define the longitudinally extending flutes, the arrow shaft 42 according to the embodiment of FIG. 9 has a generally cylindrical wall 68 defined by an external surface 70 and a following internal surface 72. The wall 68 is fashioned to have longitudinally extended, outwardly projected rectangular ribs 74 and, like the other embodiments described above, is designed to have a relatively constant wall thickness to minimize weight. Additionally, similar to the embodiments described above, the eight of ribs shown in FIG. 9 disposed at 45° intervals is for purposes of illustration and is not to be deemed as limiting. The ribs 74 have been found to strengthen the shaft 42 to permit the smaller outside diameter wall and wall thickness to be used to reduce the weight of the shaft 42 and the overall arrow 40. The ribs 74 may project approximately five percent of the radius of the shaft 42.

Figure 10:
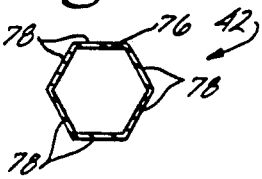
FIG. 10 is a section view of yet another embodiment of the arrow shaft according to the present invention.

In yet another embodiment of the arrow 40, the shaft 42 as shown in FIG. 10 has a wall 76 which includes longitudinally extended flats 78 which give the wall 76 a generally hexogonal cross-sectional shape. As with the previous embodiments of the arrow 40, it has been found that the flats 78 and the resultant hexogonal shape permits a smaller diameter arrow shaft 42 to be used with a thinner wall thickness and while maintaining the stiffness of the shaft 42. While the hexagonal cross section shape is preferrable, fewer or more flats may be disposed on the shaft 42 as desired.

In yet another and presently preferred embodiment of the arrow 40, the shaft 42 has a wall 80 in which flutes 82, 84, and 86 are formed. The shaft 42 has a uniform cross-section along its entire length—it is not tapered and does not have a variable wall thickness. Flutes 82, 84, and 86 are spaced apart 120° from each other circumferentially of the surface of the shaft 42, as shown. It has been found that three flutes provide good spine (stiffness), as well as arrow shaft stability, velocity, and accuracy, thus increasing marksmanship, although other numbers of flutes greater than three up to twelve have also exhibited markedly better stability than arrow shafts without flutes. Three flutes as shown is also convenient from the point of view of flight placement because the flights can be mounted between the respective flutes.

Figure 11:
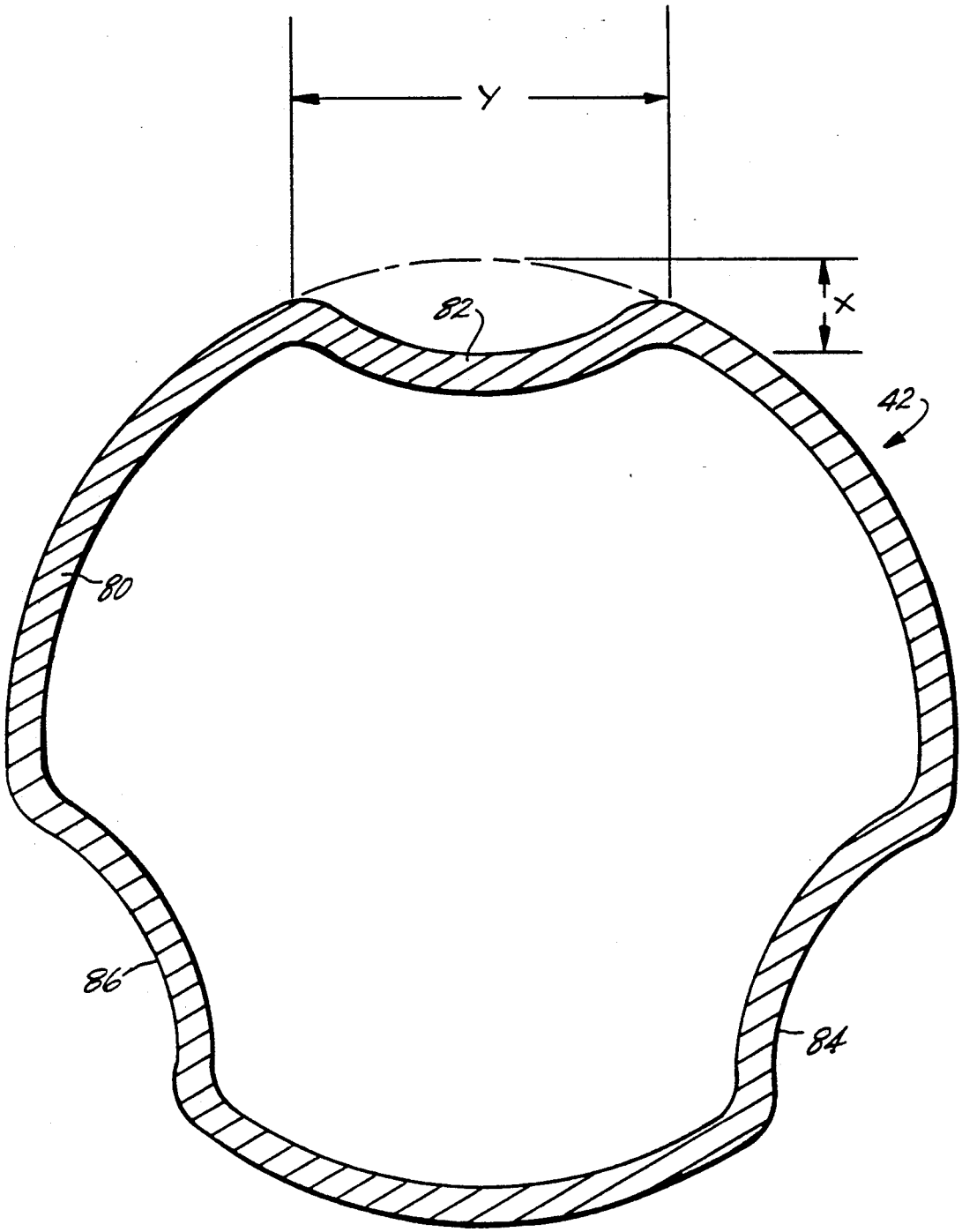
FIG. 11 is a section view of another and preferred embodiment of the arrow shaft according to the present invention.

In addition to increasing the spine per unit weight of the arrow shaft, it is believed that the flutes, particularly as descried in connection with FIG. 11, exercise boundary layer control during flight. Specifically, the flutes, when properly dimensioned, maintain the boundary layer, thus creating laminar flow which reduces the friction and drag of the arrow shaft during flight.

Specifically, shallower and/or wider flutes provide better boundary layer control and therefore better aerodynamic performance, i.e., greater range and better stability, permitting greater accuracy. (If the flutes are too deep, they tend to encourage oscillations that create separations in the boundary layer drag and cause the arrow to wobble, or cause turbulent flow.) The described boundary layer control along with the increased spine and reduced weight increases the range, flattens the trajectory, and raises the velocity of the arrow shaft at bow release. On the other hand, deeper flutes strengthen the arrow shaft. Therefore, a proper balance is struck in selection of the flute depth between boundary layer control considerations and strength.

In the embodiment of FIG. 11, the wall thickness is preferably in the range of 0.012 to 0.016 inch, the flute width, designated Y in FIG. 11, is preferably in the range of 0.050 to 0.125 inch; the flute depth designated X in FIG. 11, is in the range of 0.01 to 0.080 inch, but more specifically X is preferably in the range of 0.015 to 0.035 inch. Within these ranges, the best results were obtained with a wall thickness of 0.012 inch, a flute width Y of 0.085 inch, and a flute depth X of 0.015 inch for an arrow shaft having an outer diameter of 0.3125 inch. The tolerances should be held to within 0.001 inch.

Preferably, in all embodiments, shaft 42 is formed by cold working, specifically in a mandrel drawn process to enhance strength and durability.

When the described arrow shaft is used for game hunting, it has been found to be extremely lethal. Specifically, the flutes do not engage the flesh of the game to the same extent as the remainder of the arrow shaft upon entry into to the game target. Thus, the arrow penetrates deeper into the game target because there is less friction between the arrow shaft and the flesh and there is greater bleeding because of the channels formed by the flutes.

Figure 12:
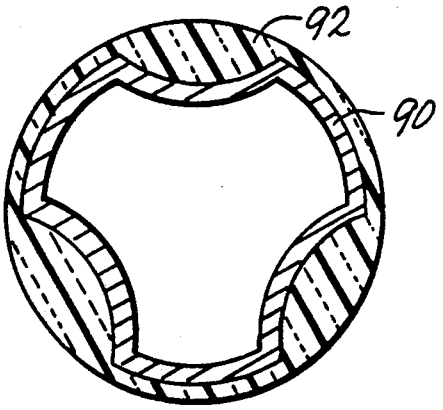
FIGS. 12 and 13 are section views of embodiments of an arrow shaft according to the invention combining a tubular aluminum carrier with a boron fiber coating.
Figure 13:
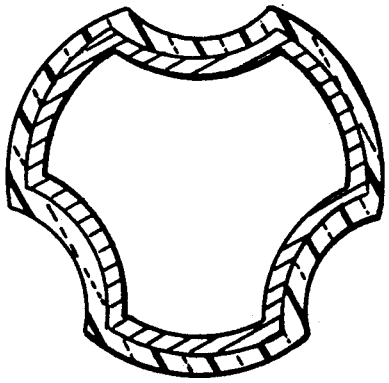

In FIG. 12 is shown a fluted arrow shaft 90 made of a thin-walled tubular carrier of aluminum coated with a boron or graphite fiber layer 92. Typically the wall thickness of the carrier is of the order of 0.004 inch and the wall thickness of layer 90 is of the order of 0.008 to 0.010 inch. This construction produces a much lighter arrow shaft without compromising strength. Layer 92 is deposited by spinning carrier 90 in a fiber resin mixture. After the resin hardens the arrow shaft is center ground to true it up. If the advantages of boundary layer control are desired, flutes are ground in layer 92, as illustrated in FIG. 13.

Figure 14:
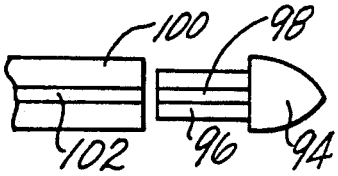
FIGS. 14 and 15 are side views of another embodiment of the invention showing an improved arrowhead before and after assembly.
Figure 15:
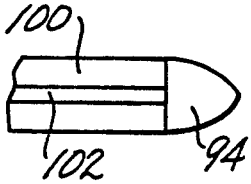

As depicted in FIG. 14, a feature of the invention is the use of a bullet shaped arrowhead 94 having a shank 96 with flutes 98. The outer diameter of shank 96 is designed to fit snugly within the hollow interior of arrow shaft 100 and flutes 98 fit within flutes 102 formed in arrow shaft 100. Before fitting shank 96 into the end of arrow shaft 100, it is coated with an adhesive to bond the two parts together. FIG. 15 illustrates arrowhead 94 mounted on arrow shaft 100 in assembled position. Flutes 98 on shank 96 serve to axially align the point of head 94 with arrow shaft 100 and secure arrowhead 94 to arrow shaft 100, without wobble under subjection to aerodynamic forces.

In summary, an arrow shaft constructed in accordance with the invention exhibits more stiffness and durability, has a flatter trajectory, because of an increase in velocity, penetrates better, and shoots with greater accuracy and straightness than conventional arrow shafts having a uniformly round cross-section. In addition, arrow shafts made in accordance with the invention are more versatile in that fewer arrow shaft sizes are required to accommodate the full range of peak bow weights and draw lengths. An arrow shaft incorporating the principles of the invention has the following properties:

Durability—Greater durability by changing the physical structure of the shaft when it is drawn, letting it accept more kinetic energy through its enlarged total surface area.

Velocity—Greater velocity by being able to lighten the arrow shaft approximately 40% and still maintain spine stiffness of the arrow shaft.

Trajectory—Flatter trajectory through the increase of velocity and B.L.C. which allows the arrow shaft to travel more smoothly while in flight.

Accuracy—Greater accuracy by the increase in stability, velocity and the elimination of oscillations which create separations in the boundary layer or laminar flow.

Penetration—Greater penetration through the increase of velocity stability and stiffness, also by the decrease of actual outside surface area. Approximately a decrease of 40% O.S.A.

Straightness—Greater straightness because of the physical structure of the aluminum when it is drawn, a greater column effect, larger total surface area and a smaller inside diameter, which makes the shaft harder to bend and gives it an incredible memory.

While I have shown and described certain embodiments of the present invention, it is to be understood that it is subject to modification without departing from the spirit and scope of the attached claims.

What is claimed is:

1. An arrow comprising:

an arrowhead;

a nock;

a cylindrical hollow shaft extending longitudinally between and mounting the arrowhead and the nock, the shaft having N longitudinally extending concave, substantially straight flutes in the form of arcuate grooves on the outer surface of the shaft, where N is three, the depth of the flutes is about 0.018 inch and the width of the flutes is about 0.085 inch; and a flight disposed on the shaft adjacent to the nock to guide and stabilize the flight of the arrow.

2. The arrow of claim 1, in which the wall thickness of the shaft is about 0.012 inch.

3. The arrow of claim 2, in which the shaft has an outer diameter of about 0.3125 inch.

4. An arrow comprising:

an arrowhead;

a nock;

a cylindrical hollow shaft of uniform cross-sectional area and form extending longitudinally between and mounting the arrowhead and the nock, the shaft having a plurality of substantially straight flutes int he form of arcuate grooves extending on the outer surface of the shaft over its entire length from the arrowhead to the nock, the flute width, depth and number being selected so as to provide better aerodynamic performance than an unfluted shaft, the shaft having three flutes, the flute width being in the range of 0.050 to 0.125 inch; and a flight disposed on the shaft adjacent to the nock to guide and stabilize the flight of the arrow.

5. The arrow of claim 4, in which the flute depth is in the range of 0.015 to 0.035 inch.

6. The arrow of claim 5, in which the wall thickness of the shaft is in the range of 0.012 to 0.016 inch.

* * * * *